US005176278A

United States Patent [19]

Quarberg

[11] Patent Number: 5,176,278

[45] Date of Patent: Jan. 5, 1993

[54] BEVERAGE CAN RESEALING DEVICE

[76] Inventor: Craig D. Quarberg, 6908 Candlewood Cir., Brooklyn Park, Minn. 55445

[21] Appl. No.: 830,184

[22] Filed: Jan. 31, 1992

[51] Int. Cl.[5] ..... B65D 51/18

[52] U.S. Cl. ..... 220/256; 220/254; 220/711; 220/729; 220/320; 222/570

[58] Field of Search ..... 220/694, 703, 704, 705, 220/711, 712, 713, 714, 715, 716, 717, 718, 719, 729, 253, 254, 256, 320; 222/570, 567, 566, 568

[56] References Cited

U.S. PATENT DOCUMENTS

| | | | |
|---|---|---|---|
| 1,197,924 | 9/1916 | Ellinger | 220/320 |
| 2,075,721 | 3/1937 | Hommel | 220/718 X |
| 2,729,956 | 1/1956 | Gilbert | 220/718 X |
| 2,864,529 | 12/1958 | Henchert | 220/729 |
| 2,887,240 | 5/1959 | Deussen | 222/566 X |
| 4,415,097 | 11/1983 | Meins | 220/711 |
| 4,579,257 | 4/1986 | Brändlein | 222/570 X |
| 4,883,192 | 11/1989 | Krugman | 220/711 |
| 4,938,379 | 7/1990 | Kellner | 220/713 X |
| 5,071,042 | 12/1991 | Esposito | 220/711 X |
| 5,088,614 | 2/1992 | Dumestre | 220/713 |

*Primary Examiner*—Allan N. Shoap
*Assistant Examiner*—Paul A. Schwarz
*Attorney, Agent, or Firm*—Haugen and Nikolai

[57] ABSTRACT

An apparatus for resealing a standard aluminum beverage can, once its lid had been punctured, consists of a cover having a threaded pour spout projecting from one surface thereof and a flared skirt surrounding the periphery of the cover along with a collar which is adapted to cooperate with the flared skirt portion of the cover to compress same against the exterior side wall of the beverage container. The collar serves as a clamping ring for maintaining a gas-tight seal between the can and the cover. A threaded cap is provided which can be screwed onto the threaded pour spout to complete the seal.

8 Claims, 1 Drawing Sheet

BEVERAGE CAN RESEALING DEVICE

BACKGROUND OF THE INVENTION

I. Field of the Invention

This invention is concerned with an apparatus for resealing a standard aluminum beverage can to better maintain the state of carbonation over a prolonged period of time.

II. Discussion of the Prior Art

Beverages sold in aluminum cans, such as soft drinks and beer, will tend to go flat in a matter of a few hours once the can has been opened. It frequently happens that a can will be opened, but not all of the contents will be consumed at one time. No effective means are now available for resealing such a beverage can to prevent loss of carbonation once it has been opened. Simple snap-on lids made of polyethylene plastic like those used for resealing coffee cans cannot maintain the pressure of the $CO_2$ gas being released from the beverage due to leakage between the rim and that type of plastic lid.

It is accordingly a principal object of the present invention to provide an improved apparatus for resealing a standard aluminum beverage can once it has been opened.

Another object of the invention is to provide a resealing apparatus for a beverage can which is highly resistent to a loss of gas pressure due to leakage.

A further object of the invention is to provide a resealing device for a beverage can which will maintain the contents fresh over a period of days.

SUMMARY OF THE INVENTION

The foregoing objects and advantages of the invention are achieved by providing a beverage can resealing apparatus which comprises a cover member having a circular, planar top with an integrally formed threaded pouring spout projecting perpendicularly from that top and with an integrally formed skirt surrounding the periphery thereof. A clamping collar is dimensioned to fit over the cover member for compressing the skirt tightly against the upper rim of a beverage can, the collar having an aperture through its top for permitting the pour spout on the cover to pass through it. By positioning the cover member over the top and crimped rim of a standard beverage can and then forcing the clamping collar over the cover, a tight seal is created. A threaded cap can be screwed onto the pour spout to prevent loss of carbonation.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
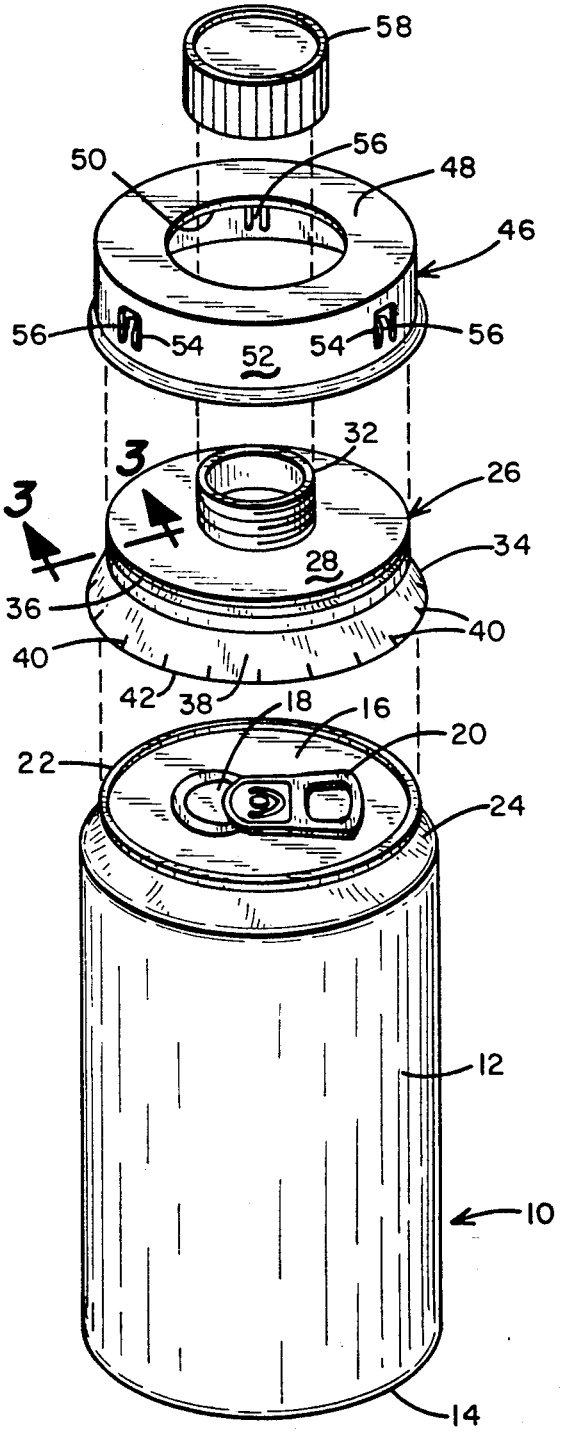
FIG. 1 is, an exploded perspective view of the invention.

In FIG. 1 there is shown a standard aluminum beverage can 10 in which soft drinks and other beverages are commonly contained. The can includes a cylindrical body portion 12 having a closed bottom 14 and a top that is covered with a crimped-on lid 16 once the drink product is introduced. The lid 16 is also typically formed from sheet aluminum and includes an arcuate opening 18 which is originally closed but which can be readily opened by lifting up on a tab 20 which acts as a lever to punch out a previously kiss-cut segment of aluminum to thereby create the opening 18. The lid 16 is crimped along its peripheral rim 22 to the can body 12. An inwardly flared segment 24 is created during the crimping process.

Younger children oftentimes cannot consume the entire contents of a can at one time. They may typically drink a portion of the contents and then will leave the can stand. After only a relatively short time, the carbonation is lost by the escape of $CO_2$ gas from the liquid and out the opening 18, rendering the drink less palatable.

In accordance with the present invention, there is provided a can resealing apparatus which comprises a cover member 26 having a circular, planar top 28 with a circular opening 30 (FIG. 2) formed therethrough, the opening being surrounded by an externally threaded, integrally formed tubular projection 32 which functions as a pour spout. Extending downwardly from the peripheral edge of the top member 28 is an integrally formed skirt 34. As can better be observed from the cross-sectional view of FIG. 3, the skirt includes an inwardly extending annular groove or recess 36 and a downwardly and outwardly flared portion 38. The flare is such that it preferably makes an angle of about 5° with a perpendicular drawn to the plane of the top member 28. As is further shown in FIG. 1, the skirt 34 is provided with a plurality of regularly spaced slits, as at 40, which extend inward from the skirt edge 42.

Figure 2:
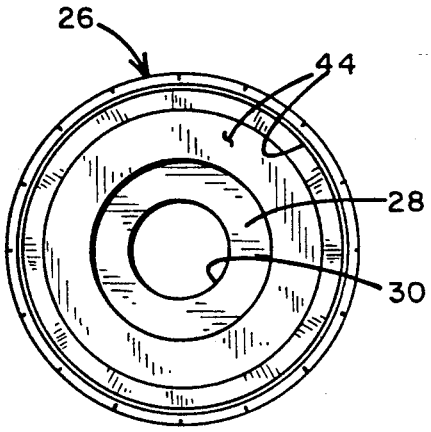
FIG. 2 is a bottom plan view of the cover member shown in FIG. 1.
Figure 3:
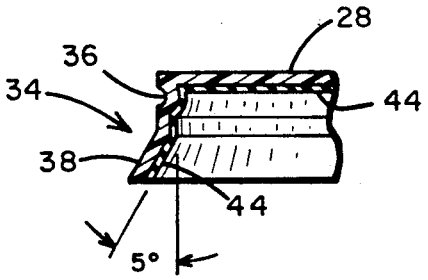
FIG. 3 is a partial cross-sectional view taken along the line 3—3 in FIG. 1.

Referring to FIG. 2, which shows a bottom view of the cover member 26, the underside of the cover 28 as well as the inside surface of the skirt 34 is preferably covered with a soft, deformable, FDA-approved elastomeric material which functions as a gasket. This elastomeric lining 44 may be eliminated, provided the cover member 26 is molded from a softer plastic, such as polyethylene, so that when pressed onto the rim 22 of the cam 10, it will penetrate slightly to create an effective seal.

A rigid, relatively non-deformable or extensible molded plastic collar member 46 is designed to surround the cover member 26 when that cover member is properly positioned on the rim 22 of the can 10. The collar member 46 is designed that when it is pressed downward about the flared segment 38 of the cover, it tightly compresses the top surface 28 and the skirt 34 against the rim 22 of the can and the walls 12 thereof especially in the flared zone 24 thereof. The collar 46 is seen to include a generally planar top surface 48 having a central circular aperture 50 formed therein which allows the tubular, externally threaded pour spout 32 to project upward through the top 48 of the collar. The collar is preferably formed from a high impact polystyrene material although no limitation to that material is intended.

Stamped, molded or otherwise formed in the side wall 52 of the collar are a series of generally rectangular openings 54, each of which surrounds and creates an inwardly bent finger-like projection 56. These fingers 56 are designed to engage the groove or recess 36 in the cover 26 to hold the collar and the cover together as a unit so that they do not become separated when not in use and when stored in a drawer or the like.

Completing the assembly is a plastic screw-on cap 58 which mates with the threaded pour spout 32.

In use, the cover 26 with the collar 46 surrounding it are pushed over a previously opened can 10. When the lining or gasket 44 on the underside of the top member 28 abuts the crimped rim 22 of the can, the collar 46 is pushed downward, causing it to compress the skirt 34 tightly against the exterior of the can. The slits 40, in effect, create a lip seal between the plastic of the skirt 34 and the side wall 12 of the beverage can 10. Pushing down on the collar in the manner described causes the collar to wedge tightly against the flared cover 38 of the cover so that it holds in that position when the downward hand force is removed. Once this assembly has been applied to the can, the user may repeatedly open the container by removing the cap 58 from the pour spout, dispensing more of the beverage through the pour spout and then reclosing it with the cap.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A beverage can resealing apparatus comprising:

(a) a cover member having a circular planar top and an integrally formed skirt surrounding the periphery of said circular planar top, said skirt flaring radially outwardly at a predetermined angle from said circular planar top of said cover member, said skirt further including an annular recess formed inwardly in a surface of said skirt and a plurality of regularly spaced slits extending inward from the edge thereof said cover member including a pour spout projecting perpendicularly from said planar top;

(b) a clamping collar having a circular planar top and an integrally formed annular sleeve dimensioned to fit over said cover member for compressing said skirt tightly against the upper rim of a beverage can, said collar having an aperture through the circular planar top thereof for receiving said pour spout therethrough and means for engaging said annular recess; and (c) a cap member for selectively closing and opening said pour spout.

2. The beverage can resealing apparatus as in claim 1 and further including a resilient, deformable lining on the inner surfaces of said planar top and skirt of said cover member.

3. The beverage can resealing apparatus as in claim 1 wherein said pour spout is externally threaded and said cap is internally threaded to screw onto said pour spout.

4. For use with an aluminum beverage can of the type having a cylindrical body with one closed end and a lid crimped to the opposite end, said lid having a stay-on tab type opening, a resealing apparatus for inhibiting loss of carbonation of the beverage once said can is opened comprising:

(a) a cover member having a planar top surface with an integrally formed downwardly and outwardly flared skirt surrounding the periphery thereof, said top surface further having a threaded pour spout adapted to overlay said stay-on tab type opening, said skirt dimensioned to closely surround the crimped lid;

(b) a clamping collar having a planar top and a non-extensible sleeve surrounding said top and extending perpendicularly thereto, said top having a circular opening therein for receiving said threaded pour spout therethrough and said sleeve being dimensioned to fit over said skirt and adapted to compress said skirt tightly against said cylindrical body and said crimped lid;

(c) a threaded cap attachable to said threaded pour spout; and (d) means on said clamping collar for coupling said clamping collar to said cover member.

5. The apparatus as in claim 4 wherein said cover member includes a resilient gasket lining a portion of said top surface and said skirt and adapted to cooperate with said cylindrical body and said lid.

6. The apparatus as in claim 4 wherein said cover member is a generally soft resilient plastic material and said clamping collar is a hard, generally non-extensible plastic.

7. The apparatus as in claim 4 wherein said coupling means includes an annular groove formed about the periphery of said skirt immediately below said top surface of said cover member and finger means formed on said sleeve of said collar for engaging said annular groove and holding said cover member and said collar together when said resealing apparatus is not being used with a beverage can.

8. The apparatus as in claim 4 wherein said outwardly flared skirt includes a plurality of regularly spaced slits extending inward a predetermined distance from the edge thereof.

* * * * *